US006293063B2

(12) United States Patent
Van Doren

(10) Patent No.: US 6,293,063 B2
(45) **Date of Patent: *Sep. 25, 2001**

(54) CAST-IN-PLACE HYBRID BUILDING SYSTEM

(76) Inventor: David A. Van Doren, 3305 Country La. P.O. Box 12, Hays, KS (US) 67601

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/536,666

(22) Filed: Mar. 27, 2000

Related U.S. Application Data

(63) Continuation of application No. 09/107,642, filed on Jun. 30, 1998.

(60) Provisional application No. 60/051,195, filed on Jun. 30, 1997.

(51) Int. Cl.[7] ..... E04B 1/20

(52) U.S. Cl. ..... 52/251; 52/250; 52/431; 52/429; 52/340; 52/252

(58) Field of Search ..... 52/423, 431, 429, 52/426, 425, 747.14, 745.18, 747.17, 724.5, 721.2, 738.1, 737.4, 252, 259, 250, 251, 334, 329, 340, 341

(56) References Cited

U.S. PATENT DOCUMENTS

| | | | | |
|---|---|---|---|---|
| 1,470,835 | * | 10/1923 | Hathaway | 52/250 |
| 1,964,816 | * | 7/1934 | Graydon | 72/42 |
| 2,116,946 | * | 5/1938 | Huntington | 52/429 X |
| 2,143,616 | * | 1/1939 | Adler | 52/423 |
| 2,372,042 | * | 3/1945 | Yankee | 52/426 |
| 3,792,830 | * | 2/1974 | Dashew et al. | 249/28 |
| 4,081,935 | * | 4/1978 | Wise | 52/236.8 |
| 4,181,286 | | 1/1980 | Van Doren . | |
| 4,879,855 | * | 11/1989 | Berrenberg | 52/426 X |
| 5,667,192 | | 9/1997 | Van Doren . | |
| 5,728,312 | | 3/1998 | Van Doren . | |
| 5,809,712 | * | 9/1998 | Simanjuntak | 52/223.7 |

FOREIGN PATENT DOCUMENTS

| | | | | |
|---|---|---|---|---|
| 3728358 | * | 3/1989 | (DE) | 52/250 |
| 633832 | * | 5/1927 | (FR) | 52/251 |
| 982407 | * | 12/1943 | (FR) | 52/359 |
| 1341426 | * | 12/1962 | (FR) | 52/250 |
| 2560256 | * | 8/1985 | (FR) | 52/250 |
| 266762 | * | 4/1927 | (GB) | 52/251 |
| 379204 | * | 1/1932 | (GB) | 52/250 |

* cited by examiner

*Primary Examiner*—Carl D. Friedman
*Assistant Examiner*—Phi Dieu Tran A
(74) *Attorney, Agent, or Firm*—Chase & Yakimo, L.C.

(57) ABSTRACT

A pre-cast concrete form for cast-in-place beams and columns and a method of forming the same. The form includes a form body having a channel through a length thereof and a shear bonding key along the length, the channel being adapted to receive cast-in-place concrete therein to form a beam or column. The shear bonding key is integrally formed in the body and has a grooved portion and a ribbed portion for bonding the cast-in-place concrete to the form body. The form body may further include a reinforcing stirrup tie cast therein and extending into the channel, adapted to secure the form body to an opposed form body. The form body may include a plurality of shear bonding keys and reinforcing stirrup ties spaced apart along the length thereof. The method includes the steps of positioning a pre-cast concrete form having a channel extending therethrough, pouring the cast-in-place concrete into the channel of the form, and bonding the concrete to the form with a shear bonding key integrally formed along the channel of the form. This method may further include the step of securing opposed forms together with a reinforcing stirrup tie extending from the forms into the cast-in-place concrete.

15 Claims, 8 Drawing Sheets

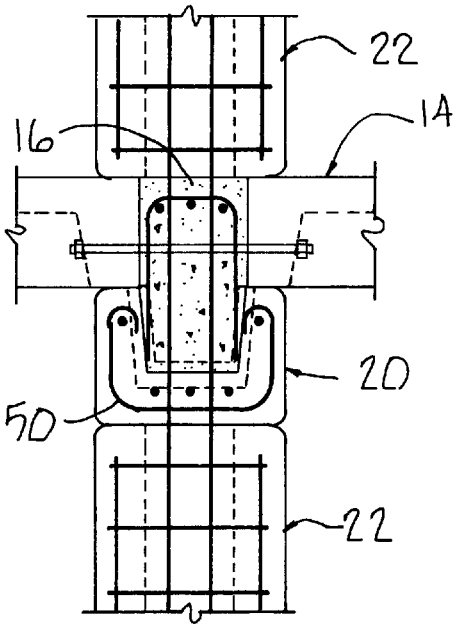
Fig. 13
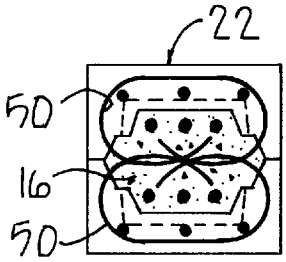
Fig. 14
Fig. 15
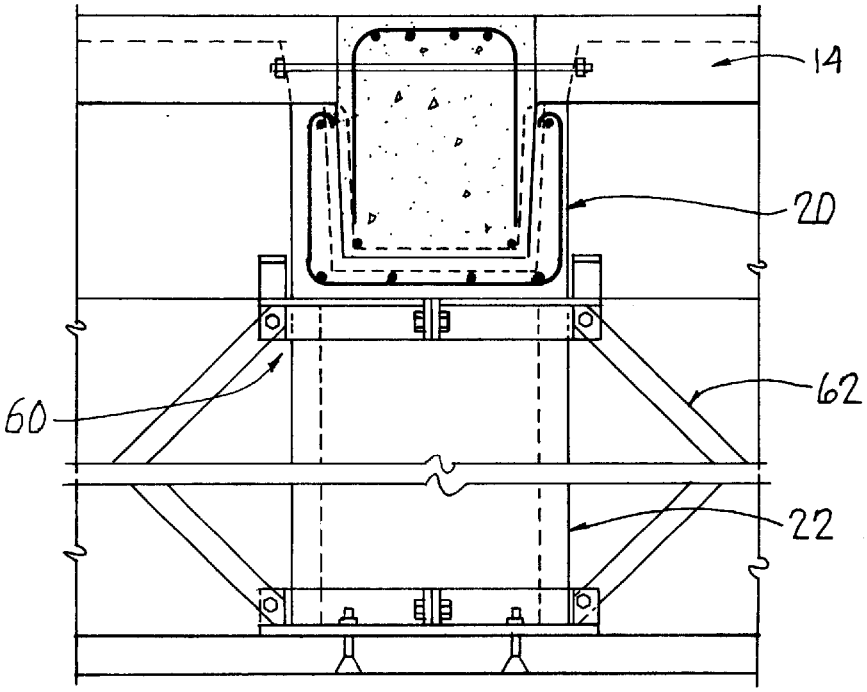

CAST-IN-PLACE HYBRID BUILDING SYSTEM

CROSS REFERENCE

This application is a continuation of application Ser. No. 09/107,642 filed Jun. 30, 1998, which claims the benefit of the prior filed provisional application, Ser. No. 60/051,195, filed Jun. 30, 1997.

FIELD OF THE INVENTION

This invention relates to a building system including a concrete precast form used as leave-in-place formwork for constructing cast-in-place concrete columns and beams for mid-rise and high-rise buildings located in both non-seismic and severe seismic areas.

BACKGROUND OF THE INVENTION

Conventionally, cast-in-place (or poured-in-place) concrete beams and columns are poured in wooden forms. After the beams and columns sufficiently cure, the wooden forms are removed and discarded, creating a large amount of wasted lumber. Furthermore, such wooden forms require extensive bracing and shoring. This method is also very time consuming, labor intensive and requires a large amount of on-site cast-in-place concrete.

Prior precast concrete leave-in-place forms have been inefficient due to the lack of shear transfer between the precast concrete of the leave-in-place form and the poured concrete therein. Without the complete composite bond and shear transfer between the precast concrete form and the cast-in-place concrete therein, the combination is inefficient and uses excessive amounts of concrete and steel reinforcing.

SUMMARY OF THE INVENTION

Accordingly, a primary object of the subject invention is to provide a building system including an elongated U-shaped precast concrete leave-in-place form having shear keys spaced apart along the length of the form that provide sufficient shear transfer between the precast concrete of the form and cast-in-place concrete poured therein resulting in a truly composite structure.

Another object of the subject invention is to provide a building system including a precast concrete form which eliminates extensive forming, shoring and waste.

Still another object of the subject invention is to provide a building system including a precast concrete form that reduces the amount of cast-in-place concrete that is required.

Yet another object of the subject invention is to provide a building system including a precast concrete form that decreases construction time and is less labor intensive.

A further object of the subject invention is to provide a building system including a precast concrete form that produces a high quality precise building frame and is aesthetically pleasing during construction.

Still further object of the subject invention is to provide a building system employing precast waffle panels as flooring which provide the composite structural floor which is intimately married to the concrete beam and column structure during pouring of the cast-in-place concrete of this hybrid system.

Yet a further object of the subject invention is to provide a building system employing precast column forms that present half-column shells having reinforcing stirrup ties cast therein which extend outwardly from each form so that when two forms are joined together into a shell, the stirrup ties of each form overlap and interlock with the cast-in-place concrete to form a unified column.

Yet a further object of the subject invention is to provide a building system having columns to which the only added reinforcing required is that used to tie one column level to the next through the beam/floor section.

These objects are attained by providing a concrete form including a form body having a channel through a length thereof and a shear bonding key along the length, the channel being adapted to receive cast-in-place concrete therein to form a beam or column. The shear bonding key is integrally formed in the body and has a grooved portion and a ribbed portion for bonding the cast-in-place concrete to the form body. The form body may further include a reinforcing stirrup tie cast therein and extending into the channel, adapted to secure the form body to an opposed form body. The form body may include a plurality of shear bonding keys and reinforcing stirrup ties spaced apart along the length thereof.

Additionally, these objects may be attained by providing a method of forming a concrete cast-in-place beam or column, including the steps of positioning a pre-cast concrete form having a channel extending therethrough, pouring the cast-in-place concrete into the channel of the form, and bonding the concrete to the form with a shear bonding key integrally formed along the channel of the form. This method may further include the step of securing opposed forms together with a reinforcing stirrup tie extending from the forms into the cast-in-place concrete.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 13 is a sectional view of a cast-in-place concrete beam mounted between two cast-in-place columns and floor paneling.

FIG. 14 is a sectional view of a cast-in-place column.

FIG. 15 is a sectional view of a cast-in-place interior beam mounted on a cast-in-place column and showing the clamp and brace support used therewith in the subject building system.

DETAILED DESCRIPTION OF PREFERRED EMBODIMENTS

Figure 1:
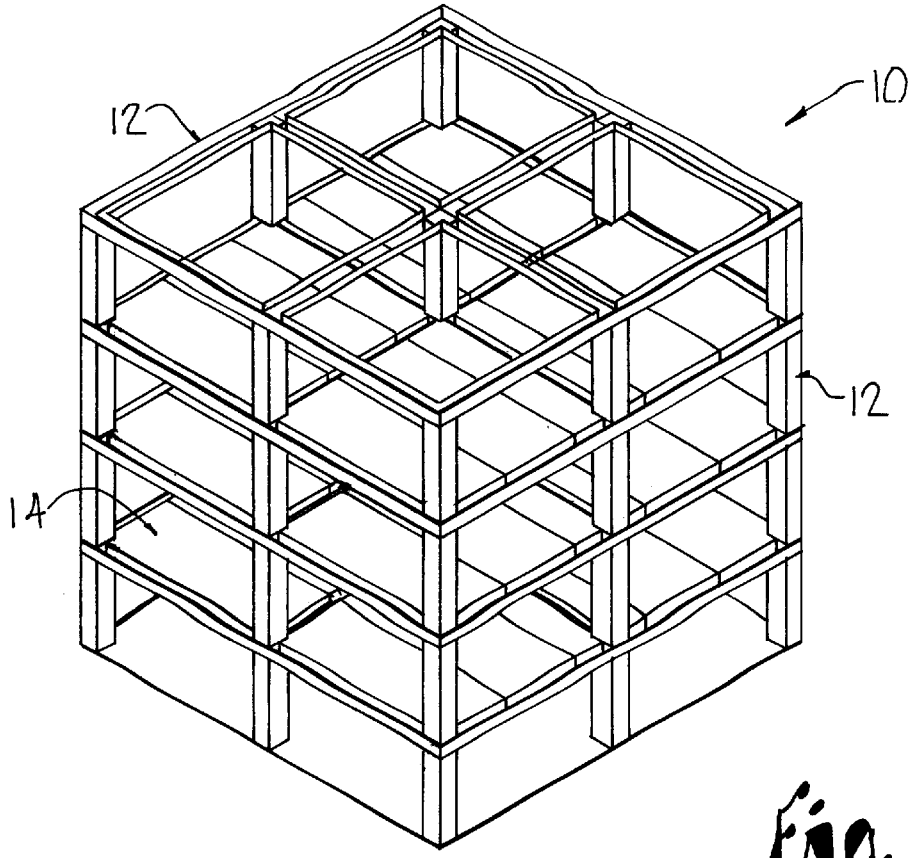
FIG. 1 is a perspective view of a building frame constructed using the building system which is the subject of this invention.

A building frame 10, as in FIG. 1, is constructed of precast forms 12 and cast-in-place concrete in accordance with the present invention. Preferably, the flooring is comprised of concrete waffle panels 14 as disclosed in my U.S. Pat. No. 4,181,286.

Precast forms 12 are preferably used for the construction of mid-rise and high-rise buildings located in both non-seismic and severe seismic areas. The forms 12 in combination with cast-in-place concrete 16 form a building system that can be designed as a Special Moment-Resisting Frame (SMRF) system or a dual system (combination SMRF and shear wall system) for buildings located in severe seismic regions. A dual system is recommended for any mid to high-rise location with potential seismic activity or high wind load. In such systems, a Waffle-Crete® cast-in-place or precast shear wall system is used to provide at least 50% of the lateral load resistance and a ductile moment frame is designed to resist the remaining lateral load. Typically, the shear walls are located at the perimeter of stair and elevator cores. The system can also be designed as an ordinary Moment-Resisting Frame (OMRF) for structures in non-seismic locations.

Figure 2:
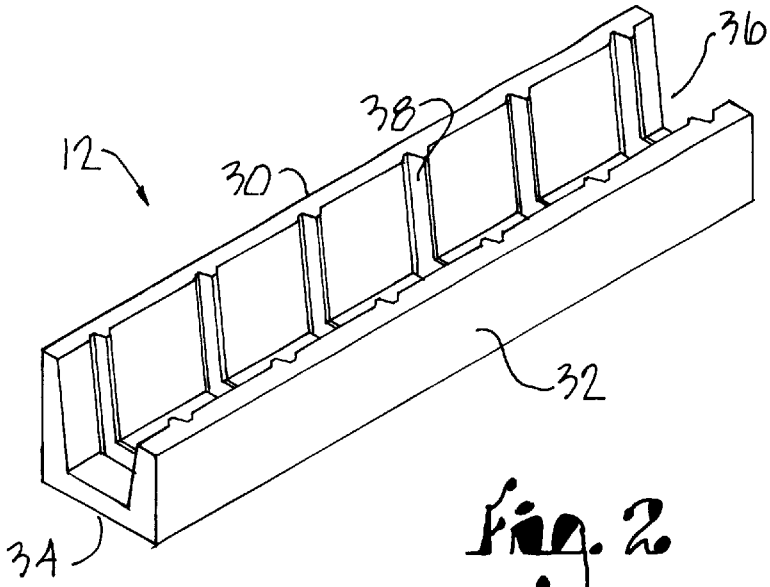
FIG. 2 is a perspective view of a precast spandrel beam form of the subject building system.
Figure 3:
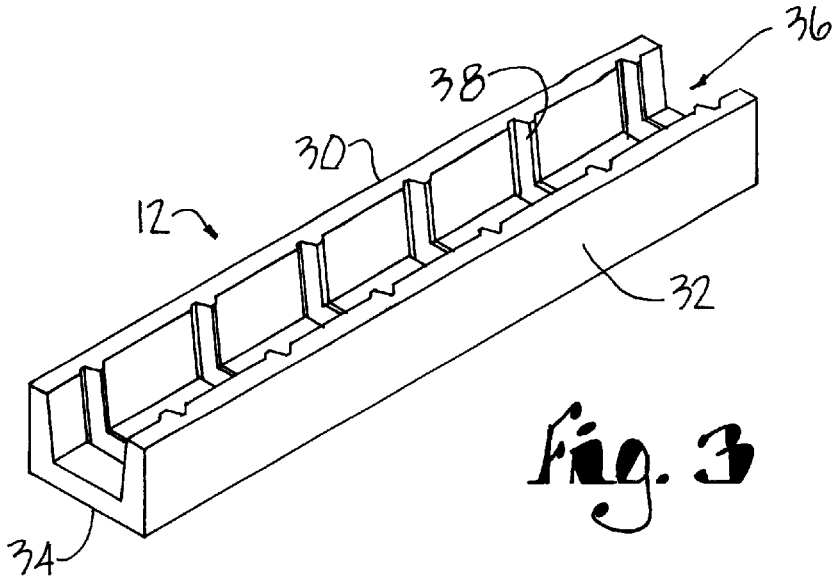
FIG. 3 is a perspective view of a precast interior beam form of the subject building system.
Figure 5:
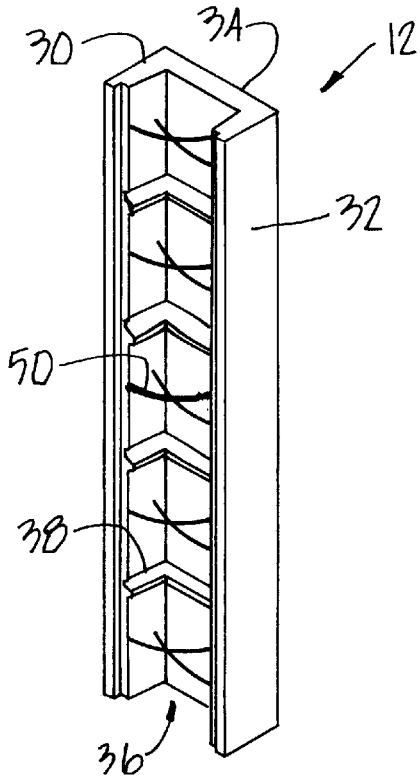
FIG. 5 is a partial perspective view of a precast concrete column form of the subject building system.
Figure 6:
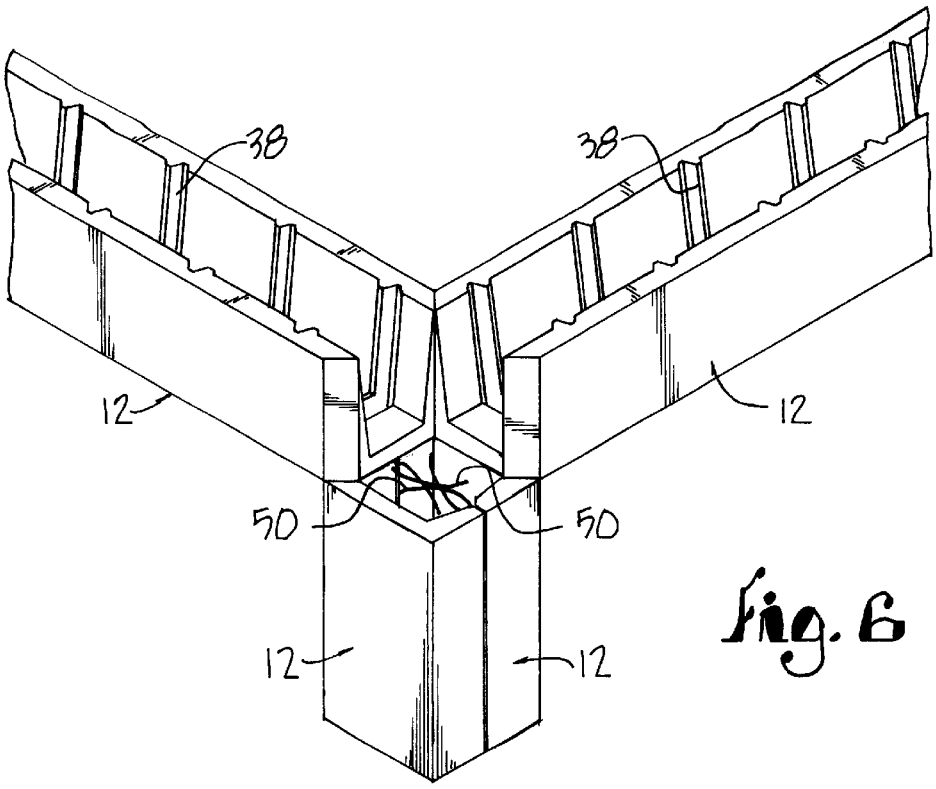
FIG. 6 is a partial perspective view of a joint between two precast interior beam forms and a precast column form.
Figure 7:
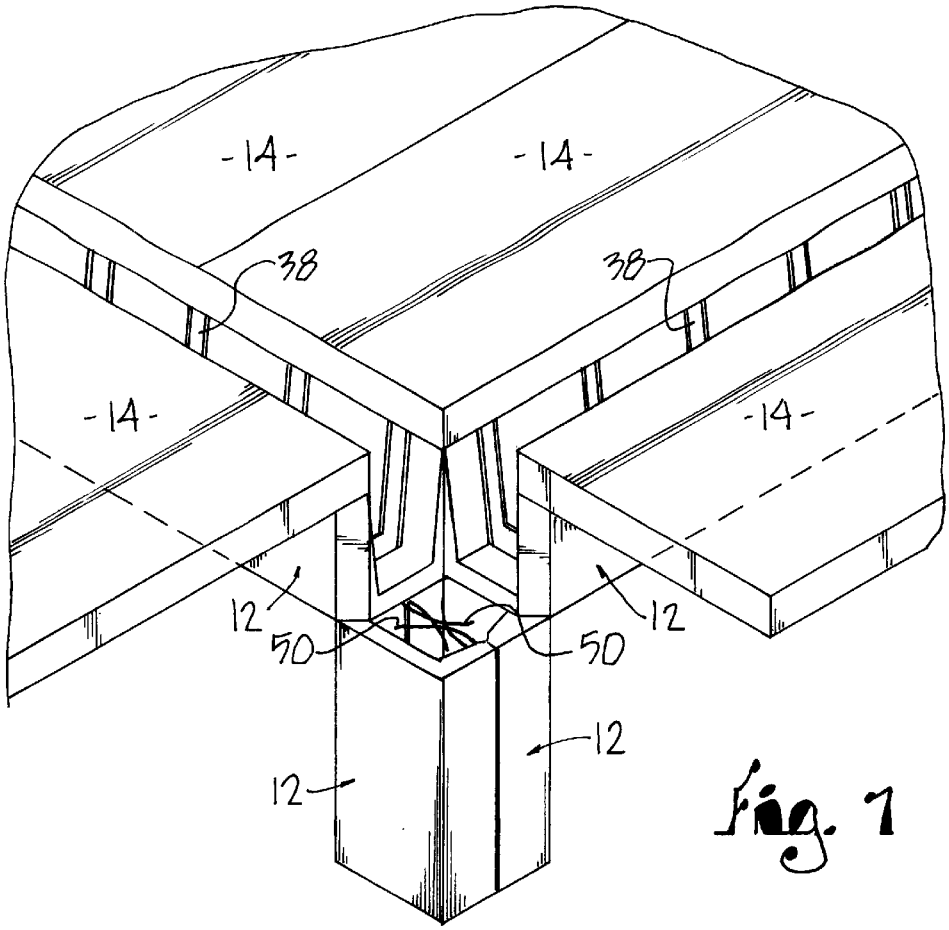
FIG. 7 is a partial perspective view of the joint of FIG. 6 showing floor paneling installed therewith.
Figure 8:
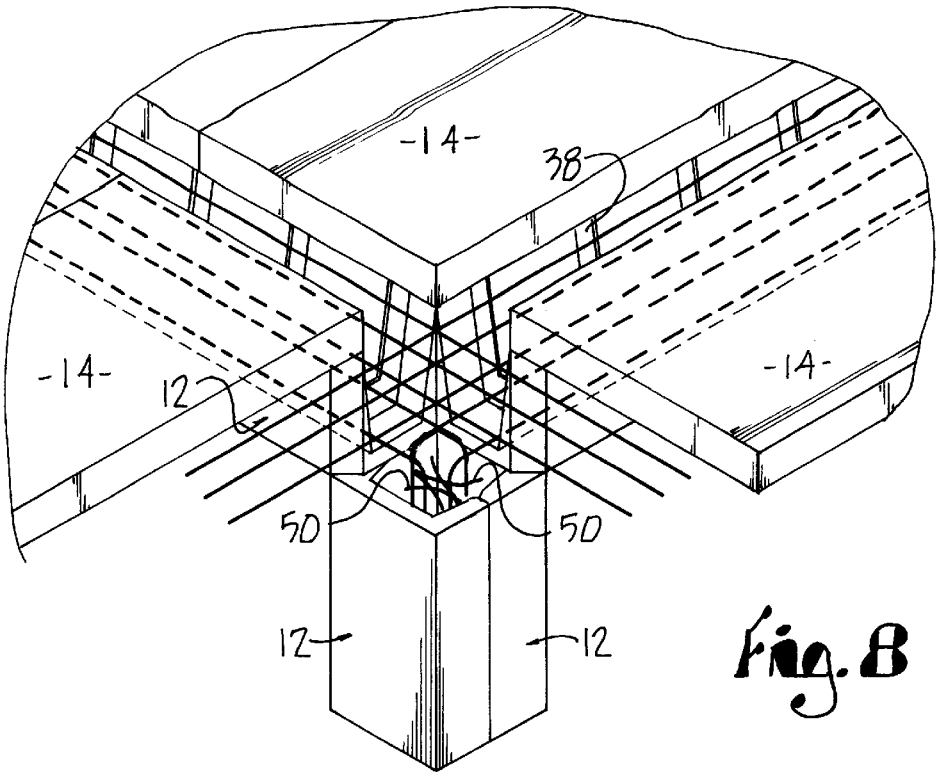
FIG. 8 is a partial perspective view of the joint of FIG. 7 now having reinforcing bar and dowels within the beam and column forms.
Figure 9:
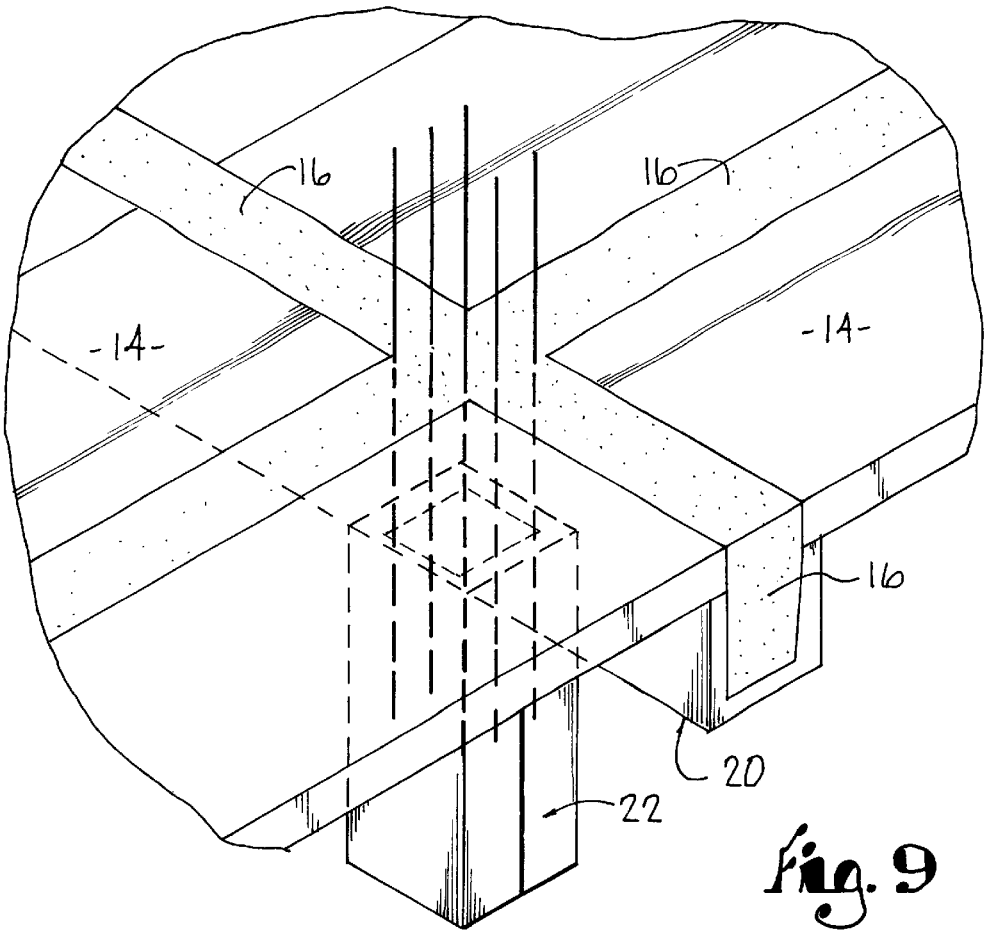
FIG. 9 is a partial perspective view of the joint of FIG. 8 showing the cast-in-place concrete beams and columns of the subject building system.
Figure 10:
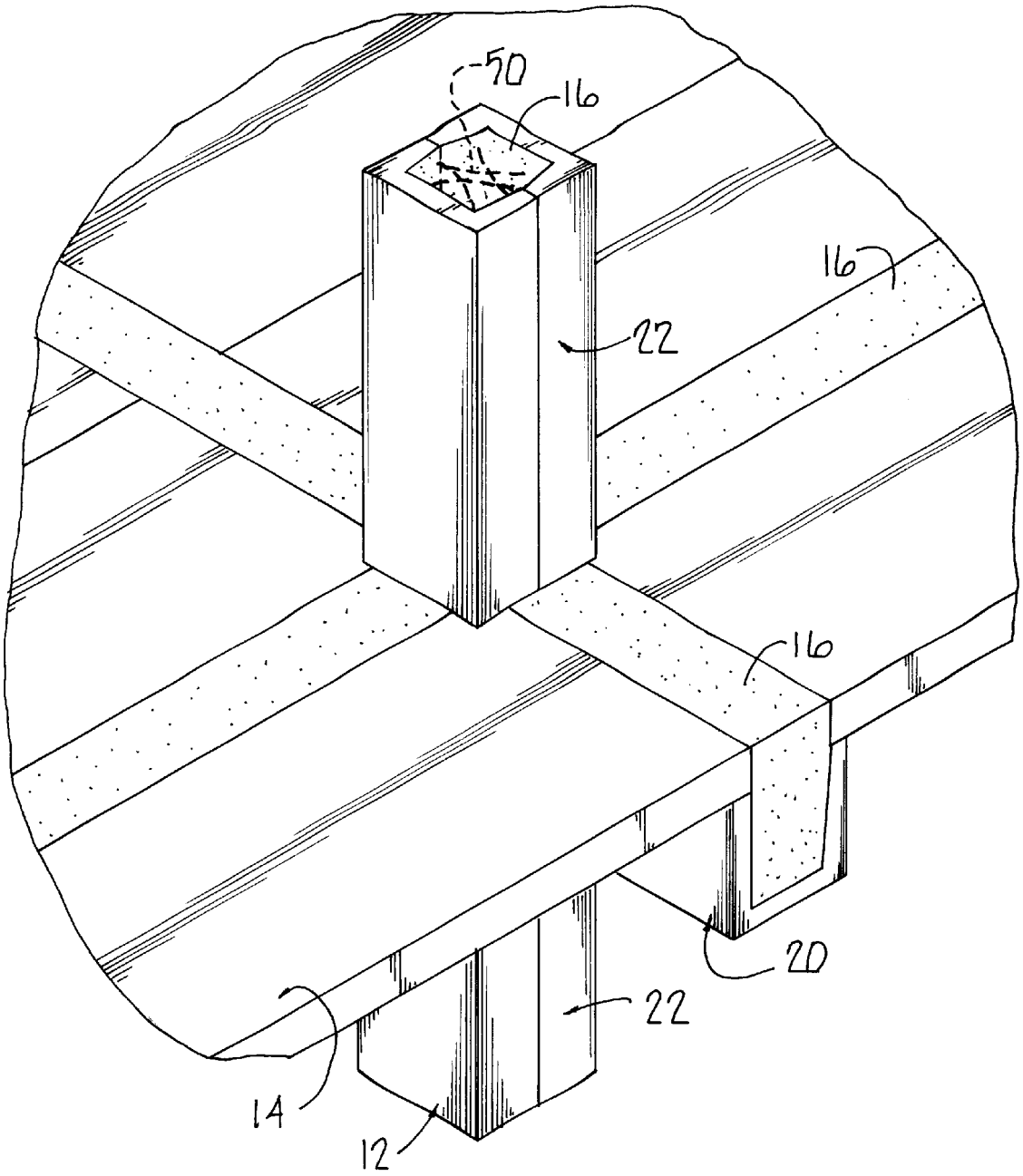
FIG. 10 is partial perspective view of the joint of FIG. 9 showing an additional cast-in-place column.
Figure 11:
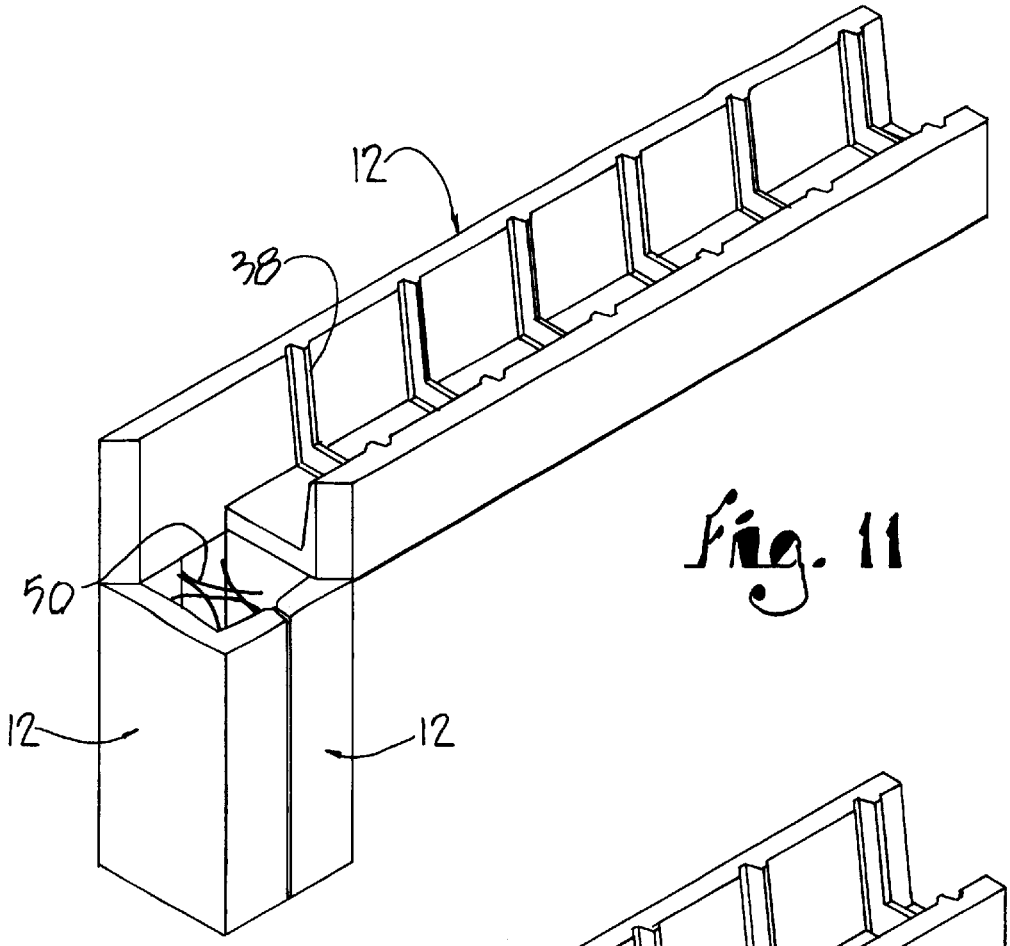
FIG. 11 is a partial perspective view of a joint between a column form and a precast spandrel beam form.
Figure 12:
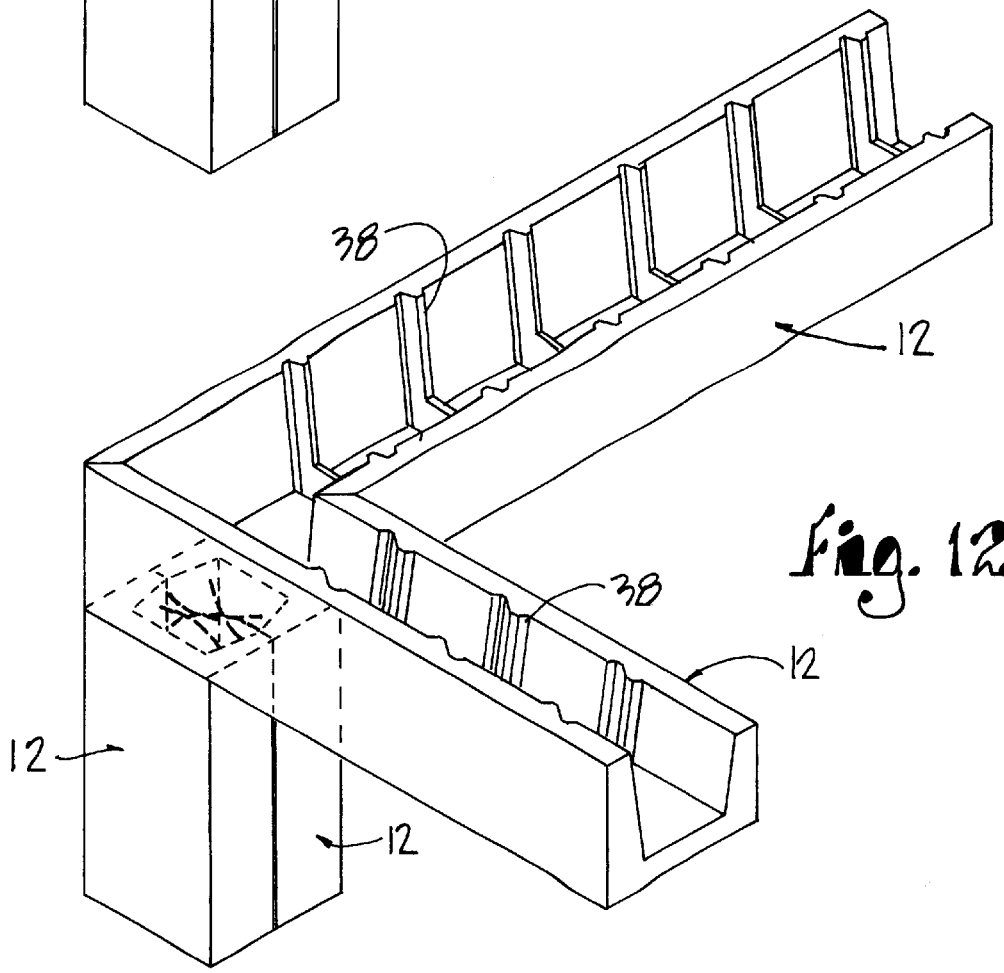
FIG. 12 is a partial perspective view of the joint of FIG. 11 but with an additional spandrel beam form.
Figure 17:
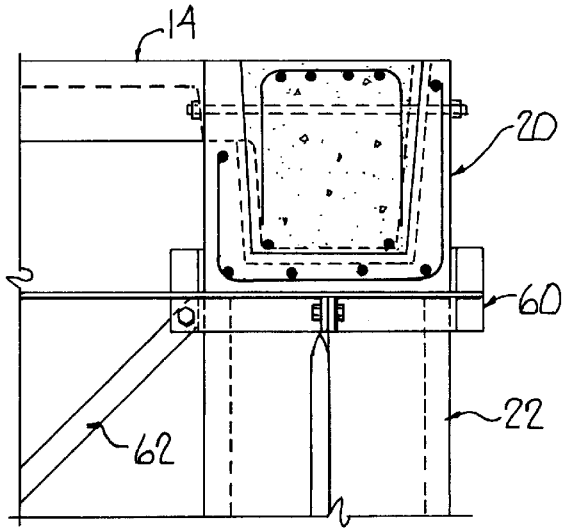
FIG. 17 is a sectional view of a cast-in-place spandrel beam mounted on a cast-in-place column and showing the clamp and brace support used therewith in the subject building system.
Figure 18:
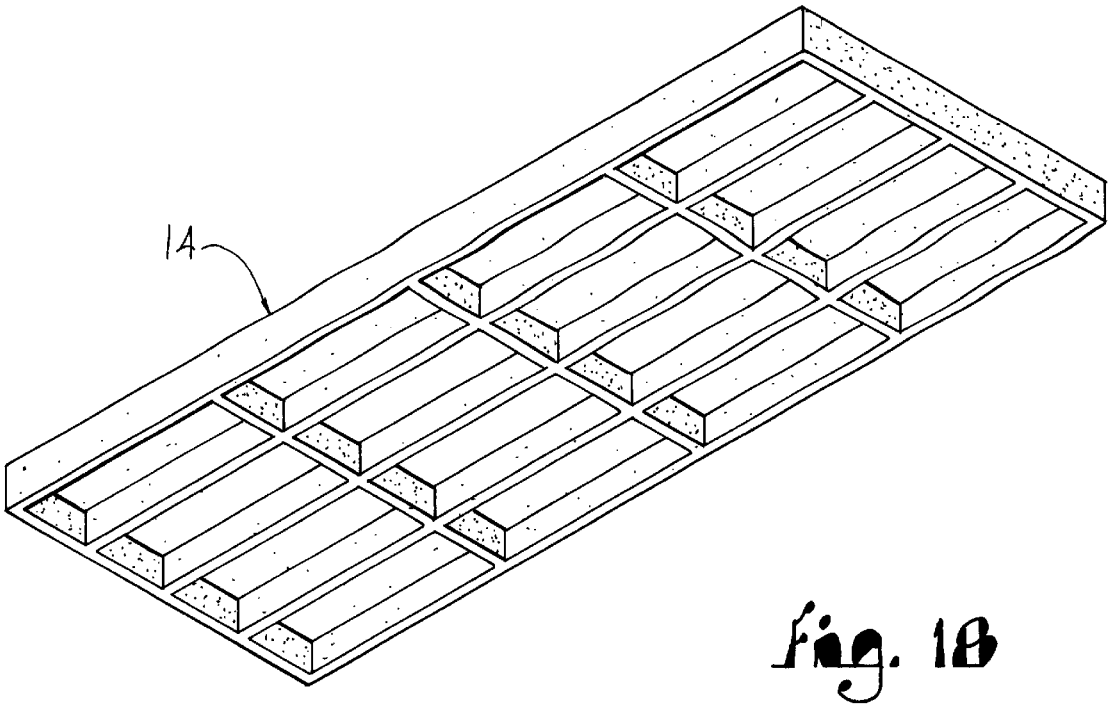
FIG. 18 is an underside perspective view of a waffle panel floor of the type shown in perspective from above in FIGS. 7–10.

Precast forms 12, as seen in FIGS. 2 and 3, are filled with cast-in-place concrete 16 to form a beam 20. See FIGS. 9, 10 and 13. Beams 20 can safely span a width of up to 40 feet and include exterior spandrel beams, see FIGS. 2 and 17, and interior beams, see FIGS. 3 and 9. Two opposed precast forms 12, as seen in FIG. 5, filled with cast-in-place concrete 16 form a column 22. See FIG. 14.

Precast forms 12 are elongated forms unitarily and integrally molded of concrete having a substantially U-shaped cross-section. Given their shape, each form 12 includes first and second spaced apart legs 30 and 32 extending parallel to one another and connected by bridging member 34 which extends between corresponding ends of legs 30 and 32 to present a channel 36 therebetween.

Figure 4:
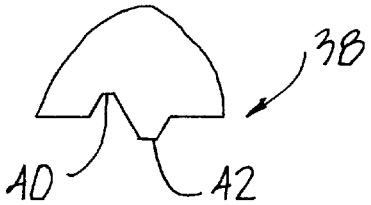
FIG. 4 is a sectional view of a shear key of a beam form of the subject building system.

Each form 12 also includes a plurality of spaced apart shear keys 38 integrally formed on the interior surface thereof. Each key 38 preferably extends continuously from the free end of leg 30 along bridge member 34 and through second leg 32 to its free end. Shearing keys 38 are substantially Z-shaped and include a rib portion 40 that extends into the channel 36 and a groove portion 42 that extends into the form 12. See FIG. 4. Keys 38 are preferably spaced apart 15" on center.

The shear key design also provides support for the reinforcing bars 44 (FIGS. 13 and 14) used during the molding of forms 12 and later for supporting and holding the cast-in-place reinforcement bars 46 the proper distance from the surfaces of the precast leave-in-place form 12.

Both column and beam forms 12 include reinforcing bar stirrup ties 50 molded integrally therein. See FIGS. 13 and 14. The free ends of stirrup ties 50 molded within column forms 12 extend from within legs 30 and 32 of column form 12 into channel 36. See FIG. 5. Stirrup ties 50 are spaced apart from each other and from shear keys 38. Preferably, one stirrup tie 50 is molded between each shear key 38 or as required by engineering design for stirrups.

The Construction Process

The construction process begins with the production of the precast U-shaped forms 12. Shear keys 38 are integrally molded with forms 12 whether forms are to be used as beams 20 or columns 22. Reinforcing bar ties 50 are also molded integrally within forms 12. After an overnight curing period, forms 12 are demolded from plastic and aluminum molds.

Columns 22 include two forms 12 placed together to present a column shell with the free ends of one form's legs 30 and 32 contacting the free ends of the opposed form's legs 30 and 32, with the channels 36 presenting a hollow passage therethrough. See FIGS. 6–8, 11 and 14.

Figure 16:
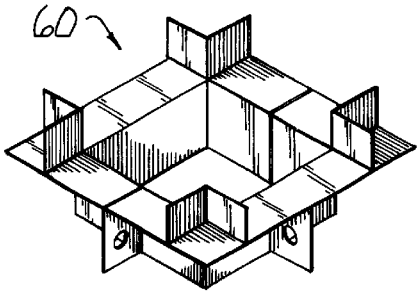
FIG. 16 is a perspective view of the clamp used with the cast-in-place columns.

Forms 12 are then erected as beams 20 and columns 22 with minimal shoring and bracing. In this regard, see FIGS. 15–17 which show column clamp 60 used to secure opposed column forms 12 together as a column 22 and the brace 62 used to support the beams 20 and columns 22. More specifically, beam forms 12 can typically span twenty feet between temporary pipe column brace 62. Temporary steel angle clamp 60 is used at the top and bottom of each column 22 to provide diagonal bracing and lateral support to the system during cast-in-place concrete placement. Thus, very little concrete patching or rubbing is required.

When the precast forms 12 and waffle floor panels 14 are in place, braced and shimmed, reinforcement bars and dowels 46 are positioned within forms 12. Compare FIGS. 7 and 8. The cast-in-place concrete 16 is then poured into forms 12 to create beams 20 and columns 22. See FIGS. 9 and 10. The precast forms 12 are designed to carry the weight of precast floor panels 14, associated forming dead loads during concrete placement and wet concrete.

The cast-in-place concrete 16 fills the groove portion 42 of each shear key 38, and the rib portion 40 of each shear key 38 extends into the cast-in-place concrete 16. In this way, the shear keys 38 sufficiently bond the form 12 to the cast-in-place concrete to create an integral, unitary structure, i.e., beam or column. Columns 22 additionally rely on the bonding action of stirrup ties 50 to sufficiently secure opposed forms 12 together for final hybrid column performance.

Having thus described the invention, what is claimed as new and desired to be secured by Letters Patent is as follows:

1. A concrete form comprising:

an elongated form body having longitudinal extending reinforcing elements therein, a channel extending through a length thereof and a plurality of shear bonding members spaced apart along said length, said channel being adapted to receive cast-in-place concrete therein to form a beam or column, and each of said shear bonding members being integrally formed in said body, and having a groove extending inwardly into said form body and a rib extending outwardly from said form body into said channel, adapted to bond the cast-in-place concrete to said form body wherein said form body has a flat interior surface from which said groove portion and said rib portion extend inwardly and outwardly, respectively.

2. A concrete form as claimed in claim 1 wherein said form body is substantially transversely U-shaped.

3. A concrete form as claimed in claim 1 wherein said form body further includes a tie member mounted to said body and extending from said body into said channel, said tie member being adapted to secure said form body to another form body.

4. A concrete form as claimed in claim 1 wherein said form body includes a plurality of tie members.

5. A concrete form as claimed in claim 4 wherein said tie members are spaced apart from said shear bonding members.

6. A building system comprising:

a beam including reinforced cast-in-place concrete secured within an elongated precast concrete form having longitudinally extending reinforcing elements therein, a column including reinforced cast-in-place concrete secured within elongated, opposed precast concrete forms having longitudinally extending reinforcing elements therein, each said form having a transversely substantially U-shaped body to present a channel extending through a length thereof receiving the cast-in-place concrete, and further having a shear bonding member, and each bonding member being integrally pre-cast with the associated form, and having a groove extending inwardly into said form body and a rib extending outwardly from said form body into said channel, adapted to bond the cast-in-place concrete to the body of the form wherein said form body has a flat interior surface from which said groove portion and said rib portion extend inwardly and outwardly, respectively.

7. A building system as claimed in claim 6 wherein said opposed forms further each include a tie member mounted on each said form extending into said channel to secure said opposed forms together.

8. A building system as claimed in claim 6 wherein each said form includes a plurality of said bonding members spaced apart along said length thereof.

9. A building system as claimed in claim 7 wherein each said form includes a plurality of said bonding members spaced apart along said length thereof.

10. A building system as claimed in claim 9 wherein said opposed forms each include a plurality of said tie members spaced apart from said bonding members.

11. A method of forming a concrete cast-in-place beam or column comprising the steps of:

(a) positioning an elongated, reinforced precast concrete form having a channel extending through a length thereof, (b) positioning elongated reinforcing elements in the channel of the form, (c) pouring cast-in-place concrete into the channel of the form, and (d) locking the cast-in-place concrete to the form with a shear bonding member integrally formed along the channel of the form, a rib portion of the bonding member extending into the poured concrete from a flat interior surface of the form and a groove portion of the bonding member extending inwardly from the flat interior surface of the form receiving the concrete therein.

12. The method as claimed in claim 11 wherein said positioning step (a) includes positioning a pair of said precast concrete forms adjacent one another in an opposed relationship, and said pouring step (c) includes pouring cast-in-place concrete into the channels of the opposed forms.

13. The method as claimed in claim 12 and further including the step of securing the opposed forms together with a tie member extending from the forms into the cast-in-place concrete.

14. The method as claimed in claim 13 wherein said step (d) includes locking the concrete to the forms with a plurality of shear bonding members spaced apart along the channel of each form, and said securing step includes securing the forms together with a plurality of tie members spaced apart from the shear bonding members.

15. The method as claimed in claim 11 wherein said step (d) includes locking the concrete to the form with a plurality of said shear bonding members spaced apart along the channel of the form.

* * * * *